US010563909B2

(12) United States Patent
Scalf et al.

(10) Patent No.: US 10,563,909 B2
(45) Date of Patent: Feb. 18, 2020

(54) REFRIGERATOR WITH A QUICK FILL DISPENSER

(71) Applicant: Midea Group Co., Ltd., Beijiao, Shunde, Foshan (CN)

(72) Inventors: Eric Scalf, Louisville, KY (US); Robert Digman, Goshen, KY (US); Paul Staun, Louisville, KY (US)

(73) Assignee: MIDEA GROUP CO., LTD., Beijiao, Shunde, Foshan, Guangdong (CN)

( * ) Notice: Subject to any disclaimer, the term of this patent is extended or adjusted under 35 U.S.C. 154(b) by 0 days.

(21) Appl. No.: 15/715,887

(22) Filed: Sep. 26, 2017

(65) Prior Publication Data

US 2019/0093942 A1 Mar. 28, 2019

(51) Int. Cl.

| | |
|---|---|
| ***F25D 23/12*** | (2006.01) |
| ***F25D 23/04*** | (2006.01) |
| ***B67D 3/00*** | (2006.01) |
| ***B67D 1/12*** | (2006.01) |

(52) U.S. Cl.

CPC ..... *F25D 23/126* (2013.01); *B67D 1/1202* (2013.01); *B67D 3/0003* (2013.01); *B67D 3/0009* (2013.01); *F25D 23/04* (2013.01); *F25D 2323/122* (2013.01); *F25D 2331/806* (2013.01)

(58) Field of Classification Search

CPC .. F25D 23/126; F25D 23/04; F25D 2323/122; F25D 2331/806; B67D 1/1202; B67D 3/0003

See application file for complete search history.

(56) References Cited

U.S. PATENT DOCUMENTS

| | | | | |
|---|---|---|---|---|
| 2,777,304 | A | 1/1957 | Nave | |
| 3,208,641 | A | 9/1965 | Brugioni | |
| 4,715,401 | A * | 12/1987 | Staun | D06F 39/001 137/355.17 |
| 5,560,393 | A * | 10/1996 | Clack | B01D 61/08 137/562 |
| 5,813,246 | A | 9/1998 | Oh | |
| 5,857,596 | A | 1/1999 | Lee | |
| 5,971,213 | A | 10/1999 | Lee | |
| 6,418,742 | B1 | 7/2002 | Chaney | |
| 6,648,187 | B1 | 11/2003 | Shypkowski | |
| 7,596,964 | B2 | 10/2009 | Lim et al. | |

(Continued)

FOREIGN PATENT DOCUMENTS

| | | |
|---|---|---|
| CN | 1707206 A | 12/2005 |
| CN | 1964913 A | 5/2007 |

(Continued)

OTHER PUBLICATIONS

GE, GE WR17X11440 Water Tank Dispenser Assembly for Refrigerator, www.amazon, Retrieved on Sep. 14, 2018.

(Continued)

*Primary Examiner* — Melvin Jones
(74) *Attorney, Agent, or Firm* — Middleton Reutlinger

(57) ABSTRACT

A refrigerator appliance having a quick fill dispenser to rapidly fill a container. The refrigerator may include a water storage receptacle. The water storage receptacle may be in fluid communication with a water filter. The water storage receptacle may dispense water at a flow rate greater than the flow rate entering the water storage receptacle. A valve may be downstream of the water storage receptacle.

25 Claims, 4 Drawing Sheets

(56) References Cited

U.S. PATENT DOCUMENTS

| | | | | |
|---|---|---|---|---|
| 8,763,422 | B2 | 7/2014 | Zentner et al. | |
| 9,115,930 | B2 | 8/2015 | Park et al. | |
| 9,568,240 | B2 | 2/2017 | Hall et al. | |
| 9,651,296 | B2 | 5/2017 | An | |
| 9,709,321 | B2 | 7/2017 | Yang | |
| 9,752,820 | B2 | 9/2017 | Yang | |
| 2007/0000949 | A1 | 1/2007 | Bosi | |
| 2009/0126392 | A1* | 5/2009 | An | F25D 23/126 62/389 |
| 2010/0275633 | A1* | 11/2010 | An | C02F 9/005 62/318 |
| 2010/0293986 | A1 | 11/2010 | Jung | |
| 2011/0303693 | A1 | 12/2011 | Culley et al. | |
| 2012/0111031 | A1* | 5/2012 | Lee | F25D 23/126 62/66 |
| 2012/0195577 | A1 | 8/2012 | Lee | |
| 2012/0297814 | A1* | 11/2012 | Kim | F25D 23/126 62/340 |
| 2013/0105513 | A1* | 5/2013 | Krause | B67D 1/0858 222/69 |
| 2013/0108249 | A1 | 5/2013 | Krause et al. | |
| 2014/0217121 | A1 | 8/2014 | Fernandez | |
| 2015/0197417 | A1 | 7/2015 | Stagg et al. | |
| 2016/0209108 | A1 | 7/2016 | Bird | |

FOREIGN PATENT DOCUMENTS

| | | | |
|---|---|---|---|
| CN | 102209682 | A | 10/2011 |
| CN | 102374715 | A | 3/2012 |
| CN | 102374742 | A | 3/2012 |
| CN | 105371576 | A | 3/2016 |
| CN | 106642953 | A | 5/2017 |
| CN | 207113363 | U | 3/2018 |
| JP | S61163490 | A | 7/1986 |
| KR | 20120039885 | A | 4/2012 |
| KR | 20130061430 | A | 6/2013 |
| WO | 2010119016 | A2 | 10/2010 |

OTHER PUBLICATIONS

Amazon, Leakproof 1-Gallon Refrigerator Water Bottle with Faucet & Screw Cap, www.amazon.com, Retrieved on Sep. 14, 2018.
Transmittal of Related Applications.
2-Faucet Beer Refrigerator, Beverage Factory, May 19, 2017.
International Search Report and Written Opinion issued in Application No. PCT/CN2018/074179 dated Jun. 13, 2018.
International Search Report and Written Opinion issued is Application No. PCT/CN2019/094321 dated Sep. 26, 2019.

* cited by examiner

REFRIGERATOR WITH A QUICK FILL DISPENSER

BACKGROUND

The present embodiments relate to a quick fill dispenser integrated into a refrigerator appliance.

Users often use a water dispenser from a refrigerator appliance to fill small containers such as, for example, drinking glasses. However, this practice often dispenses water at a flow rate that is unable to quickly fill large containers. Thus, there is a need to rapidly fill containers, for example, pitchers, beverage coolers, cooking pots, coffee makers, and/or sport bottles, etc., from a refrigerator.

SUMMARY

In some embodiments of the invention, for example, a refrigerator appliance may comprise a housing defining at least a food compartment. In various embodiments, the refrigerator appliance may include at least one door attached to the housing. In some embodiments, the refrigerator appliance may include a water storage receptacle having an inlet and an outlet. In addition, in various embodiments, the refrigerator appliance may include a valve in downstream fluid communication with the water storage receptacle to dispense water at a first flow rate from the outlet. Moreover, in some embodiments, the refrigerator appliance may include a water filter having a second flow rate in upstream fluid communication with the inlet of the water storage, wherein the first flow rate from the outlet may be greater than the second flow rate exiting the water filter.

In some embodiments, the water storage receptacle may be in at least one of the door and/or the housing. In various embodiments, the water storage receptacle may be in the housing. In addition, in some embodiments, the first flow rate may be about 1 gallon per minute to about 2 gallons per minute. In various embodiments, the water storage receptacle may further comprise a vent. In some embodiments, the valve may gravity dispense water at the first flow rate from the outlet. In various embodiments, the refrigerator appliance further comprises a pump in fluid communication with the water storage receptacle and the outlet. Moreover, in some embodiments, the water storage receptacle may be at least one of a bladder, a tank, and/or a conduit. In some embodiments, the outlet may include a laminar flow device. In some embodiments, the laminar flow device may be an aerator.

In various embodiments, a refrigerator appliance may comprise a housing defining at least a food compartment. In some embodiments, the refrigerator appliance may include at least one door attached to the housing. In addition, in some embodiments, the refrigerator appliance may include a water storage receptacle having an inlet and an outlet, wherein the outlet may include a valve in downstream fluid communication with the water storage receptacle, and wherein the valve includes a first position and a second position. Moreover, when in the first position the valve may be closed and wherein when in the second position the valve may be open and water flows out of the valve at a first flow rate, and wherein water flows at a second flow rate entering the inlet of the water storage receptacle. In some embodiments, the first flow rate may be greater than the second flow rate.

In addition, in some embodiments, the valve may include a third position, wherein in the third position the valve may dispense water at a third flow rate less than the first flow rate.

In various embodiments, the water storage receptacle may be at least one of a tank, a bladder, and/or a conduit. In some embodiments, the refrigerator appliance may further comprise a water filter in upstream fluid communication with the inlet of the water storage receptacle. In addition, in various embodiments, the water storage receptacle may be vented. In some embodiments, the water storage receptacle may be in at least one of the door and/or the housing. In various embodiments, the valve may include a lockout feature.

In various embodiments, a method of quickly filling a container from a refrigerator appliance may comprise the step of providing a refrigerator appliance, wherein the refrigerator appliance includes a first dispenser. In some embodiments, the first dispenser may include a water storage receptacle, wherein the water storage receptacle may include an inlet and an outlet. In various embodiments, the outlet may include a downstream valve and a coupling. In some embodiments, the method may include dispensing water from the water storage receptacle through the valve at a first flow rate greater than a second flow rate entering the inlet of the water storage receptacle. Moreover, in some embodiments, the method may include releasably securing one or more attachments to the coupling of the outlet.

In addition, in some embodiments, the method may include the step of filtering the water upstream of the water storage receptacle. In various embodiments, the method may include the step of indicating volume of the water within the water storage receptacle to the user. In some embodiments, the first flow rate may be about 1 gallon per minute to about 2 gallons per minute. Moreover, in some embodiments, the refrigerator appliance may include a second dispenser having a third flow rate, wherein the first flow rate may be larger than the third flow rate. In various embodiments, the method may include at least one of heating and/or cooling water within the water storage receptacle. In some embodiments, the water storage receptacle may be in a housing of the refrigerator appliance. In various embodiments, the one or more attachments may extend the distance the water is dispensed from the refrigerator appliance. Moreover, in some embodiments, the coupling may be a quick connector. In various embodiments, the method may include at least one of pumping and/or gravity dispensing the water from the water storage receptacle.

These and other advantages and features, which characterize the embodiments, are set forth in the claims annexed hereto and form a further part hereof. However, for a better understanding of the embodiments, and of the advantages and objectives attained through its use, reference should be made to the Drawings and to the accompanying descriptive matter, in which there is described example embodiments. This summary is merely provided to introduce a selection of concepts that are further described below in the detailed description, and is not intended to identify key or essential features of the claimed subject matter, nor is it intended to be used in limiting the scope of the claimed subject matter.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described techniques and apparatuses within a residential refrigerator appliance such as refrigerator appliance 10, such as the type that may be used in single-family or multi-family dwellings, or in other similar applications. However, it will be appreciated that the herein-described techniques and apparatuses may also be used in connection with other types of refrigerator appliances in some embodiments. For example, the herein-described techniques may be used in commercial applications in some embodiments. Moreover, the herein-described techniques may be used in connection with various refrigerator appliance configurations. Implementation of the herein-described techniques within french door refrigerators, bottom freezer refrigerators, top freezer refrigerators, wine refrigerators and beverage centers, compact refrigerators, etc. would be well within the abilities of one of ordinary skill in the art having the benefit of the instant disclosure, so the embodiments are not limited to the side-by-side refrigerator implementation discussed further herein.

Figure 1:
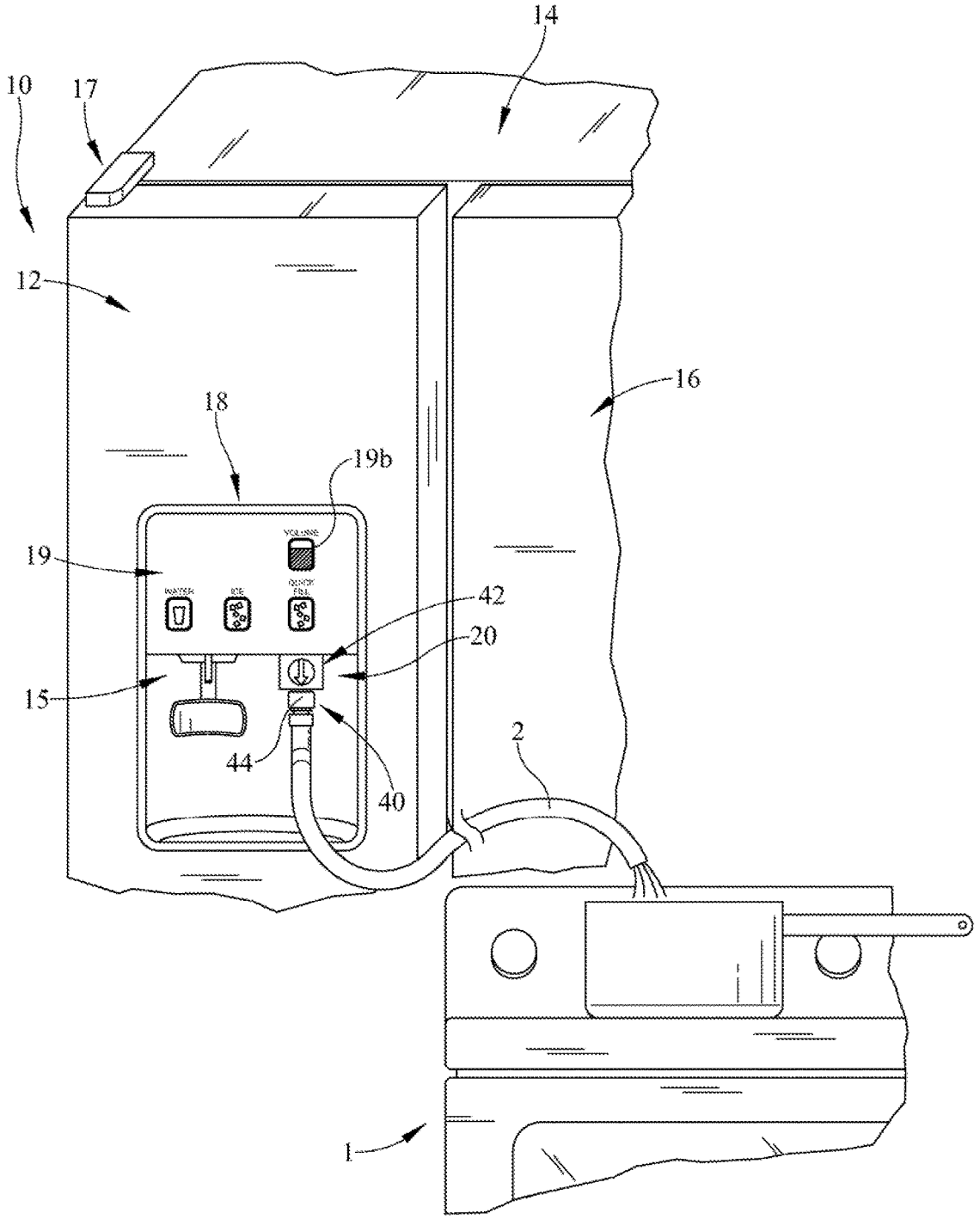
FIG. 1 is an enlarged front view of one embodiment of a refrigerator utilizing a gravity water dispenser located near a range appliance, with portions of the refrigerator and range appliance broken away.

Turning now to the drawings, FIG. 1 illustrates an example refrigerator appliance 10 in which the various technologies and techniques described herein may be implemented. Refrigerator appliance 10 is depicted in this example as a side-by-side refrigerator, and as such includes front-mounted door 12 in a cabinet or housing 14 that provides access to the freezer compartment 13 (FIG. 2) housed within the cabinet or housing 14. Similarly an adjacent pivotable door 16 may provide access to the fresh-food compartment (not shown) and when in the open position, food and beverage items may be inserted into and removed from the fresh-food compartment. Door 12 is generally provided with a hinge 17 along a side or top edge of the housing 14 and is pivotable between a closed position illustrated in FIGS. 1 and 2 and an open position (not shown). When door 12 is in the open position, food and beverage items may be inserted into and removed from the freezer compartment 13 through the door 12 or, alternatively, through an opening in the door 12. Control over refrigerator appliance 10 by a user is generally managed through a control panel 18, which can be disposed on a door such as door 12. Control panel 18 can also be disposed within the freezer compartment 13 in another embodiment, or in multiple doors, and can be utilized with a user interface 19 for the refrigerator appliance 10. It will be appreciated that in different refrigerator appliance designs, control panel 18 may include various types of input and/or output devices, including various knobs, buttons, lights, switches, textual and/or graphical displays, touch screens, etc. through which a user may configure one or more settings, determine the status of the quick fill dispenser, and start and/or stop a quick fill dispenser, set the flow rate, as described herein.

Figure 2:
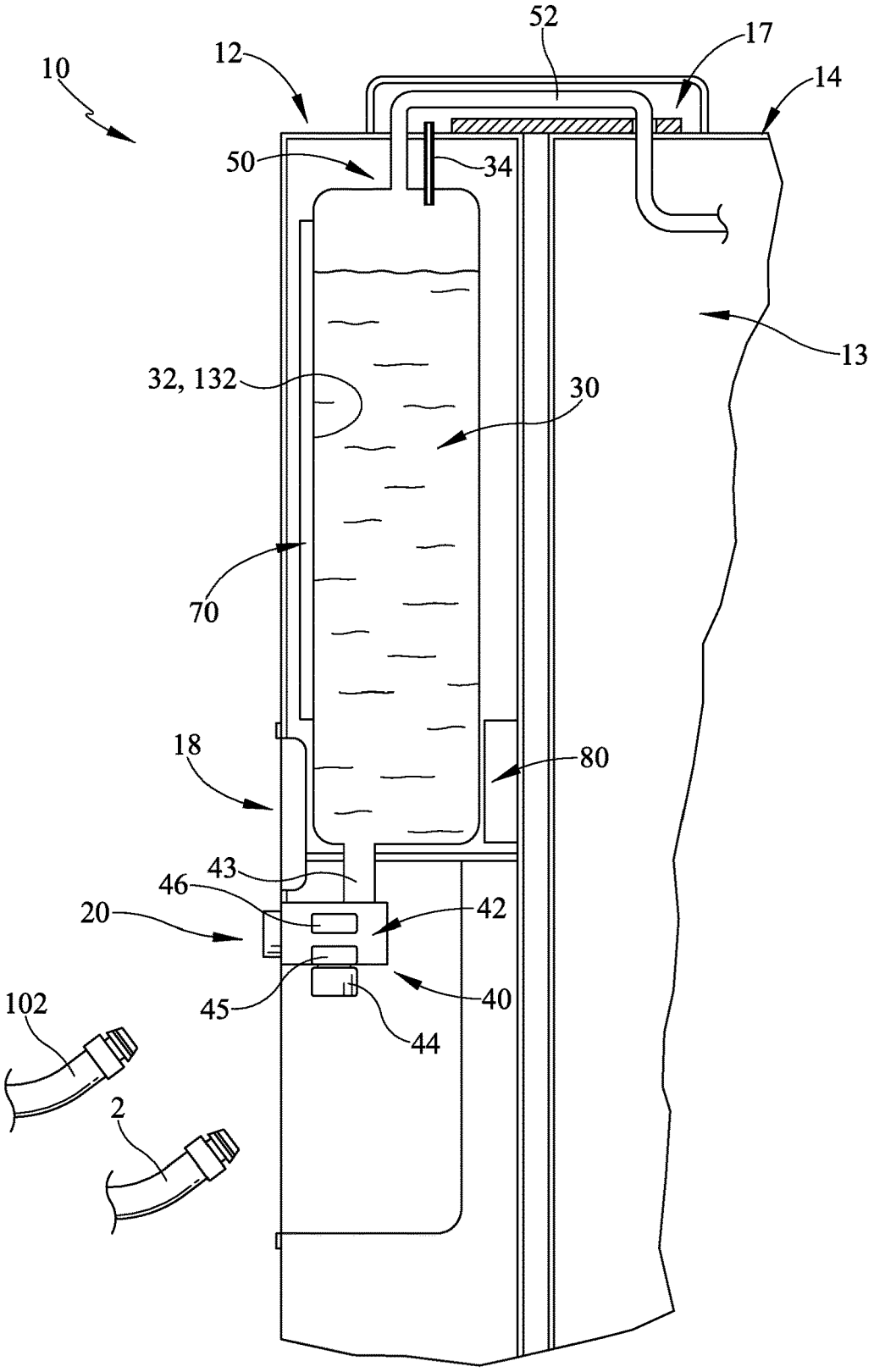
FIG. 2 is a schematic side view of one embodiment of the gravity water dispenser in the refrigerator door, with portions of the refrigerator appliance broken away.
Figure 3:
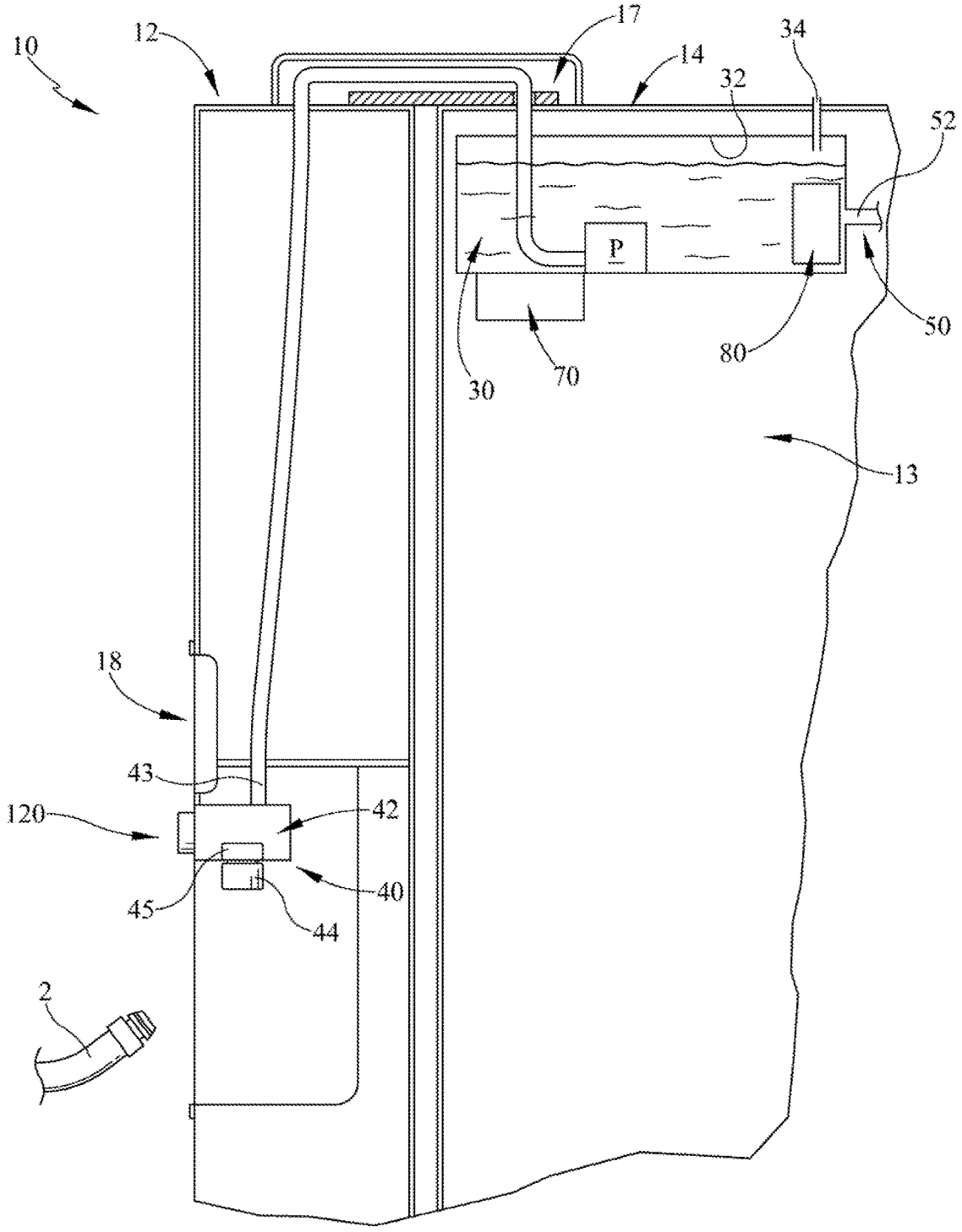
FIG. 3 is a schematic side view of one embodiment of the water dispenser in the refrigerator housing utilizing a pump, with portions of the refrigerator appliance broken away.

As shown in the Figures, a refrigerator appliance 10 may include a quick fill or first dispenser 20 to fill the container. Referring to FIG. 2, the quick fill dispenser 20 may include at least one water storage receptacle 30 positioned in the refrigerator. The water storage receptacle 30 quickly feeds one or more downstream outlets 40, as opposed to the typical water dispenser which uses water pressure to dispense water and/or allows water to flow through a water filter 60 at restricted flow rates of a water filter throughput. The water storage receptacle 30 may be in a variety of locations and configurations within the refrigerator 10. More specifically in some embodiments, the water storage receptacle 30 may be positioned in the door 12 (FIG. 2) and/or the housing 14 (FIG. 3). In some embodiments, the dispensed water exiting the water storage receptacle 30 is in fluid communication with one or more downstream outlets 40. The outlet 40 may include at least one valve 42. The valve 42 may be positioned downstream of and/or at a lower elevation than at least a portion of the water storage receptacle 30 to control a variety of flow rates and/or volumes of water that is dispensed. The water flow rate from the water storage receptacle 30 and/or outlet 40 may be pumped, gravity dispensed, and/or pressurized, etc. to quickly dispense the water from the refrigerator appliance 10. A variety of flow rates may be used within the embodiments, as desired by the user. For example, the water flow rate may be in the range of about 1 gallon per minute to about 2 gallons per minute. In a preferred embodiment, the water flow rate may be about 1 gallon per minute. Moreover, the flow rates may be adjustable. In various embodiments, a second dispenser 15 (e.g. water for drinking glasses/cups) may be included with the refrigerator 10, which can be the typical dispenser known on common versions of refrigerators. In the embodiment shown, the second dispenser 15 may have a water flow rate less than the quick fill dispenser 20.

The water storage receptacle 30, or portions thereof, may be located within the refrigerator 10 in a variety of locations. In some embodiments, the water storage receptacle 30, or portions thereof, may be positioned above the outlet 40 of the quick fill dispenser 20. As shown in the embodiment in FIG. 2, the water storage receptacle 30 may be included in the door 12 of the refrigerator 10. The water storage receptacle 30 may include an opening or inlet 50 for an upstream water line 52 to be attached. In the embodiment shown, the water line 52 fills the water storage receptacle 30 using water pressure, and is subsequently gravity dispensed from water storage receptacle 30. In other embodiments, the water may be dispensed by a pump, pressurized, etc. The water line 52 may be routed, for example, from the housing 14 into the door 12. The water line 52 may be routed adjacent the door hinge 17. In some embodiments, a hose connection (not shown) may be used between the door 12 and the housing 14 to allow the one or more doors 12 to be removable. In various embodiments, the water line 52 and/or inlet 50 may be in fluid communication with a water filter 60. In some embodiments, the quick fill water storage receptacle 30 may be filled with water that may not be in fluid communication with the water filter 60. When bypassing the water filter 60, if used, the water storage receptacle 30 may be refilled more quickly. Opposite the inlet 50, and downstream of the water storage receptacle 30, may be at least one outlet 40. The outlet 40 may be configured to adjust the flow rate (e.g. gravity flow rate) of water exiting the water storage receptacle 30. In the embodiment shown, the outlet 40 may include a hose or conduit 43, laminar flow device 45, and/or valve 42 to allow water to flow out of the quick fill dispenser 20 via gravity. If used, the one or more hoses 43 may have, for example, a diameter in the range of about ⅜ inch to about ½ inch. The size of the hose 43 may be adjusted to increase/decrease the water flow rate (e.g. similar to the water output of a kitchen faucet). The laminar flow device 45, if used, may be a variety of devices to control the water flow characteristics (e.g. an aerator). The valve 42 may be connected to the end of the hose 43 to control the water flow rate from the water storage receptacle 30. In a preferred embodiments, a ¼ turn valve may be used. The flow rate from the valve 42 could be adjusted (e.g. decreased and/or increased) depending on the desired amount of water to be dispensed therethrough. For example, an intermediate or third valve position between the closed position and open position (FIG. 1) of the valve 42 may have a lower flow rate than the maximum flow rate of a fully open valve 42 in the open position. The duration of supplying water (e.g. gravity and/or pumped) from the quick fill dispenser 20 may be manually and/or automatically started and/or ended by the refrigerator appliance 10. The user may manually start and/or end the supplying of the water. In some embodiments, a trigger and/or micro switch may be used to start and/or stop water flow. The user may open and close the valve 42 to quickly dispense at least a portion of the volume of water from the water storage receptacle 30. For example, an on/off switch and/or valve 42 may be used by the user to operate the quick fill dispenser 20. In other embodiments dispensing (e.g. gravity, pump, and/or pressure) may be automated. For example, the water may be dispensed and automatically ended upon a predetermined duration or volume being dispensed. Moreover, in various embodiments, a time algorithm may be used to dispense a set amount of water before stopping. The valve 42 may be electronically activated in some embodiments. Further, in some embodiments, the valve 42 or user interface 19 may be child-resistant (e.g. push and turn) or have a lockout feature 46 (e.g. button/switch) to reduce the likelihood of an unauthorized user (e.g. a child) from opening the valve and/or any undesired dispensing activity.

A variety of water flow rates may be quickly dispensed from the water storage receptacle 30. For example, in some embodiments, the first flow rate downstream of the water storage receptacle 30 and/or outlet 40 may be greater than the second flow rate upstream of the water storage receptacle 30 and/or inlet 50. Moreover, in various embodiments, if a water filter 60 is used upstream of the water storage receptacle 30, the first flow rate may be described as being greater that the allowable flow rate from the water filter 60 outlet (e.g. or the second flow rate exiting/downstream of the water filter) and/or entering the inlet 50 and/or water storage receptacle 30. Some typical water flow rates from a water filter may be about ½ to about ¾ gallons per minute.

The interior volume of the water storage receptacle 30 may be a variety of quantities. For example, the interior volume may vary based on the door size. In a preferred embodiment, the water storage receptacle 30 may hold approximately 1 gallon of water therein. The total volume or a portion thereof of water within the water storage receptacle 30 may be dispensed and be sufficient to supply at the water flow rate. For example, without refilling the tank while dispensing (e.g. dispensing one gallon of water from a one gallon tank). In other embodiments, the water storage receptacle 30 may be undersized in volume and still meet the larger volume and/or flow rate demanded to be dispensed, with a substantially instantaneous re-fill. For example, a ¾ gallon tank, with a ¼ gallon per minute refill time, could dispense approximately a gallon in one minute.

A variety of water storage receptacles 30 may be positioned in a variety of positions within the refrigerator appliance 10. In some embodiments, the water storage receptacle 30 may be a tank 32 (FIG. 2), conduit (not shown), and/or bladder 132, etc. The tank 32 may be blow-molded plastic or injection molded. If a bladder is used, the bladder 132 may be rubber or other suitable materials that may collapse and/or expand based upon the volume of fluid contained within. If a conduit is used, the conduit may be a coiled hose, pipe, or cylinder structure. As shown in the embodiment in FIG. 2, the tank 32 may be used within the door 12. In some embodiments of the quick fill dispenser 20, a vent 34 may be used in fluid commination with the water storage receptacle 30. For example, the vent 34 may be positioned at the top of the tank 32, vented into one or more of the refrigerator compartments, vented within one or more doors, or vented to the exterior of the refrigerator, etc. As shown in FIG. 2, the vent 34 may exit from the top of the door 12. Moreover, in some embodiments, the vent 34 may include a backflow preventer to reduce or prevent water from escaping. Although the quick fill dispenser 20 and its components are shown in detail in the figures, it is merely representative of some embodiments, and it is to be understood that there are a variety of shapes, sizes, orientations, constructions, quantities, and locations within the refrigerator 10 which may be used and still be within the scope of the teachings herein. For example, in some embodiments (e.g. FIG. 2), the quick fill dispenser 20 may include vacuum panels in the door 12. For example, vacuum panels, if used, may be used to maintain one or more compartments of the refrigerator 10 at one or more desired temperatures when the doors are closed.

As discussed above in some embodiments, the water storage receptacle 30 may be positioned in the refrigerator housing 14. As shown in the embodiment in FIG. 3, the water storage receptacle 30 of the quick fill dispenser 120 may be positioned in the top of the refrigerator housing 14. In the embodiment, the quick fill dispenser 120 may include the outlet hose 43 extending through the hinge 17 to the dispenser exit or outlet location of the door 12. As compared to the embodiment in FIG. 2, the door insulation may be minimized and vacuum panels may not be needed for the embodiment in FIG. 3. The quick fill dispenser 120 may include a pump P in fluid communication with the water storage receptacle 30 and the outlet 40. It should be understood, that other methods may be used to dispense the water from the water storage receptacle 30 (e.g. pressure and/or gravity). Moreover, in some embodiments, a bladder or conduit may be used for the water storage receptacle in the housing 14.

In some embodiments, the quick fill dispenser 20, 120 may include a hot/cold plate 70 to heat and/or cool the water storage receptacle's water within. If used, the hot/cold plate 70 may be positioned adjacent the water storage receptacle 30. The hot/cold plate 70 adjacent the water storage receptacle 30 may allow the user to set the temperature of the water therein (e.g. about 40 to 90 degrees Fahrenheit). The temperature may be displayed on the control panel 18 in some embodiments. The user interface 19 may allow the user to select the desired temperature of the water within the water storage receptacle 30.

In various embodiments, the outlet 40 of the quick fill dispenser 20, 120 may include one or more couplings 44 to releasably secure one or more downstream attachments 2. As shown in FIGS. 1-3, the valve 42 and/or outlet 40 may include a coupling 44 (e.g. hose quick connector and/or garden hose thread feature) to allow an additional downstream attachment 2 (e.g. second hose 102, extension, or accessory). In some embodiments, the attachment 2 may be added as an extension to increase the distance the dispensed water may be discharged from the refrigerator 10 to a container or dispensing target area. For example, the additional hose or attachment 2 may be used to fill a pot or container on an adjacent range 1 as shown in FIG. 1, a coffee maker on the kitchen counter, large pitcher, coffee carafe, etc.

In addition, in various embodiments, the quick fill dispenser 20 may include sensors 80 to monitor characteristics of the water in the water storage receptacle 30 (e.g. tank 32). Characteristics of the water may include, but are not limited to, status (e.g. full, empty, refill, ready to dispense, etc.), temperature, volume available to dispense, duration to fill, flow rate, etc. Sensor 80 may include electronic and/or mechanical devices used to monitor the quick fill dispenser 20, 120 and/or water therein, such as but not limited to a float, laser eye, water level switch, a conductivity sensor, a weight sensor (e.g. load cell), flow sensor (e.g. flowmeter), optical sensor, temperature sensor (e.g. infrared sensor, wired or wireless contact sensor), timer, wired or wireless sensors, etc. In various embodiments, a light or fill gage 19*b* or other indicators may be used in the user interface 19 to highlight the feature and communicate when the quick fill dispenser 20 is available.

Figure 4A:
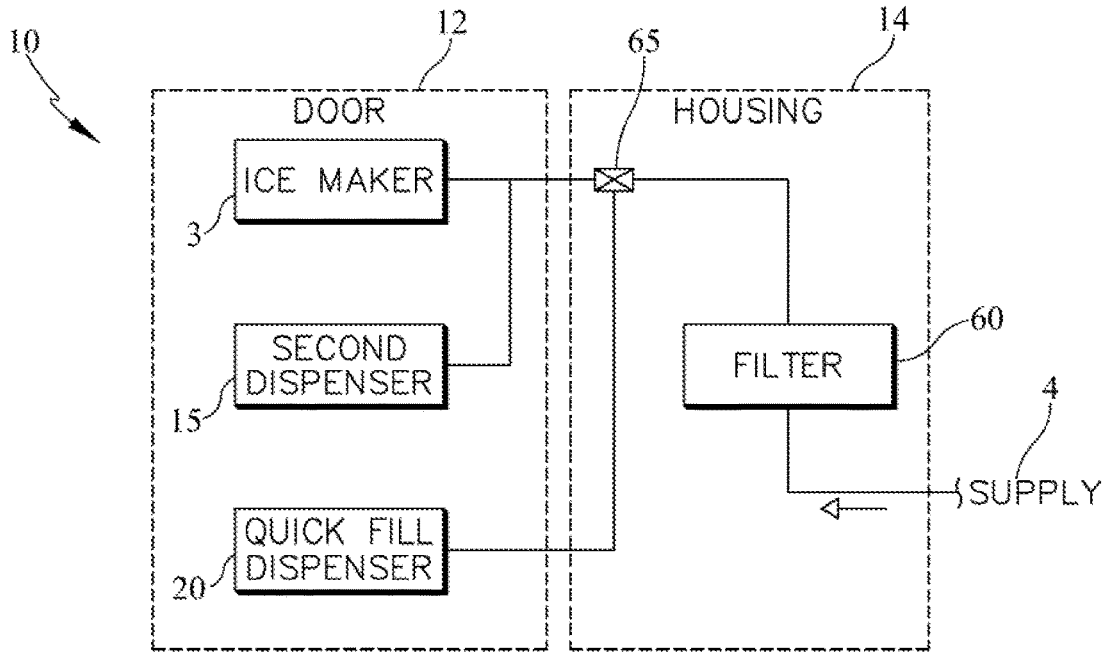
FIG. 4A is a block diagram of an example water flow system for the gravity water dispenser of the refrigerator appliance of FIG. 1.
Figure 4B:
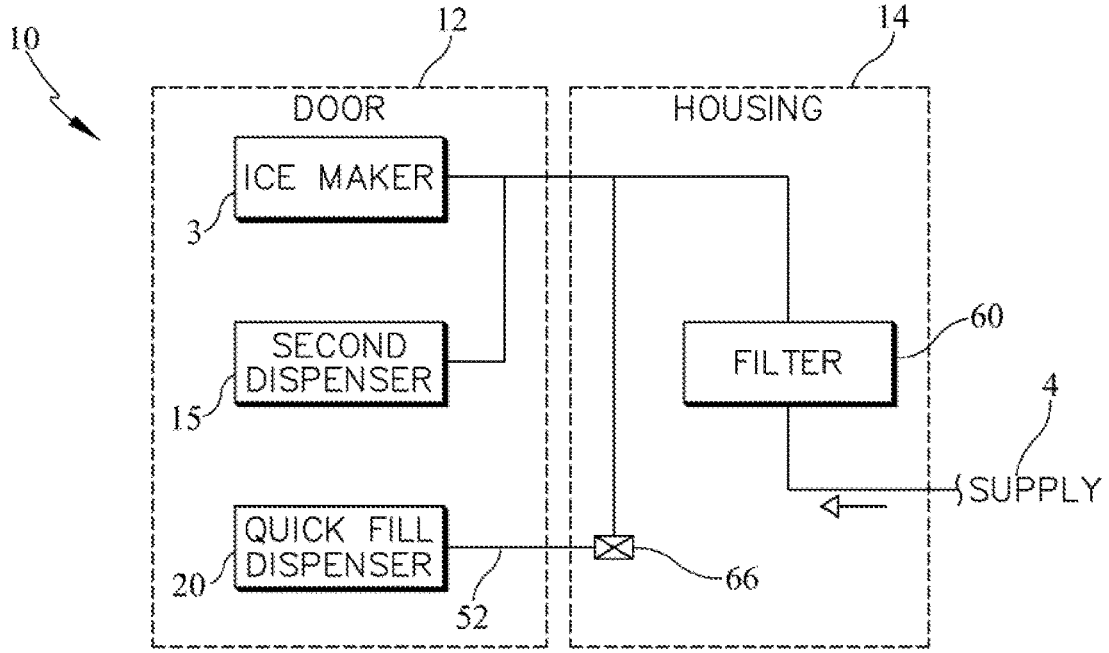
FIG. 4B is a block diagram of another embodiment of an example water flow system for the gravity water dispenser of the refrigerator appliance of FIG. 1.

As shown in the schematic of FIGS. 4A and 4B, the water storage receptacle 30 and/or quick fill dispenser 20, 120 is in downstream fluid communication with the pressurized water supply 4 to the refrigerator appliance 10. Although the quick fill dispenser 20 is shown as downstream of the water filter 60 in FIGS. 4A and 4B, it should be understood that a water filter 60, if used, may not be included in fluid communication with a variety of embodiments of the quick fill dispenser 20, 120. As illustrated in FIG. 4A, in one embodiment, the quick fill dispenser 20 may be filled when one or more valves 65 turn off fluid communication to the ice maker 3 and/or second dispenser 15. The one or more valves 65 may shut off flow to the quick fill dispenser 20 while being in fluid communication with the ice maker 3 and/or second dispenser 15. Alternatively, in some embodiments as shown in FIG. 4B, the quick fill dispenser 20 may be filled without stopping the water flow communication to the ice maker 3 and/or second dispenser 15. The one or more valves 66 would control only water flow downstream to the quick fill dispenser 20. Further, although not shown, the water storage receptacle 30, in some embodiments, may have additional outlets/exiting water lines to fill the ice maker 3 and/or second dispenser 15 directly from the reservoir of the tank 32 or water storage receptacle 30. This embodiment may reduce the length and/or quantity of water lines through the door hinge or within the door.

The refrigerator appliance 10 may be, in whole or in part, under the control of a controller (not shown) that receives inputs from a number of components and drives a number of components in response thereto. The controller may, for example, include one or more processors and a memory (not shown) within which may be stored program code for execution by the one or more processors. The memory may be embedded in the controller, but may also be considered to include volatile and/or non-volatile memories, cache memories, flash memories, programmable read-only memories, read-only memories, etc., as well as memory storage physically located elsewhere from the controller, e.g., in a mass storage device or on a remote computer interfaced with controller.

In various embodiments, the controller may be interfaced with various components, including the aforementioned quick fill dispenser 20, 120, second dispenser 15, outlet valve 42, vent 34, water filter 60, one or more valves 65, 66, pump P, control panel 18, one or more sensors 80, and/or hot/cold plate 70. In addition, controller may be coupled to a user interface 19 including various input/output devices such as knobs, dials, sliders, switches, buttons, lights, textual and/or graphics displays, touch screen displays, speakers, image capture devices, microphones, etc. for receiving input from and communicating with a user, e.g., as may be disposed in a control panel 18. In some embodiments, controller may also be coupled to one or more network interfaces, e.g., for interfacing with external devices via wired and/or wireless networks such as Ethernet, Bluetooth, NFC, cellular, and other suitable networks. Additional components may also be interfaced with controller, as will be appreciated by those of ordinary skill having the benefit of the instant disclosure. Moreover, in some embodiments, at least a portion of controller may be implemented externally from a refrigerator appliance, e.g., within a mobile device, a cloud computing environment, etc., such that at least a portion of the functionality described herein is implemented within the portion of the controller that is externally implemented.

In some embodiments, the controller may operate under the control of an operating system and may execute or otherwise rely upon various computer software applications, components, programs, objects, modules, data structures, etc. In addition, controller may also incorporate hardware logic to implement some or all of the functionality disclosed herein. Further, in some embodiments, the sequences of operations performed by controller to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. A refrigerator appliance comprising:

a housing defining at least a food compartment;

at least one door attached to the housing;

a water storage receptacle having an inlet and an outlet;

a first dispenser, wherein the first dispenser includes a valve in downstream fluid communication with the water storage receptacle to dispense water at a first flow rate from the outlet;

a water filter having a second flow rate in upstream fluid communication with the inlet of the water storage, wherein the first flow rate from the outlet is greater than the second flow rate exiting the water filter; and a second dispenser having a third flow rate, wherein the first flow rate from the outlet is greater than the third flow rate.

2. The refrigerator appliance of claim 1 wherein the water storage receptacle is in at least one of the door and the housing.

3. The refrigerator appliance of claim 2 wherein the water storage receptacle is in the housing.

4. The refrigerator appliance of claim 1 wherein the first flow rate is about 1 gallon per minute to about 2 gallons per minute.

5. The refrigerator appliance of claim 1 wherein the water storage receptacle further comprises a vent.

6. The refrigerator appliance of claim 1 wherein the valve dispenses water by gravity at the first flow rate from the outlet.

7. The refrigerator appliance of claim 1 further comprising a pump in fluid communication with the water storage receptacle and the outlet.

8. The refrigerator appliance of claim 1 wherein the water storage receptacle is at least one of a bladder, a tank, and a conduit.

9. The refrigerator appliance of claim 1 wherein the outlet includes a laminar flow device, wherein the laminar flow device is an aerator.

10. A refrigerator appliance comprising:

a housing defining at least a food compartment;

at least one door attached to the housing;

a water storage receptacle having an inlet and an outlet, wherein the outlet includes a valve in downstream fluid communication with the water storage receptacle, and wherein the valve includes a first position and a second position, wherein when in the first position the valve is closed and wherein when in the second position the valve is open and water flows out of the valve at a first flow rate, and wherein water flows at a second flow rate entering the inlet of the water storage receptacle;

wherein the first flow rate is greater than the second flow rate; and wherein the valve includes a third position, wherein in the third position the valve dispenses water at a third flow rate less than the first flow rate.

11. The refrigerator appliance of claim 10 wherein the water storage receptacle is at least one of a tank, a bladder, and a conduit.

12. The refrigerator appliance of claim 10 further comprising a water filter in upstream fluid communication with the inlet of the water storage receptacle.

13. The refrigerator appliance of claim 10 wherein the water storage receptacle is vented.

14. The refrigerator appliance of claim 10 wherein the water storage receptacle is in at least one of the at least one door and the housing.

15. The refrigerator appliance of claim 10 wherein the valve includes a lockout feature to reduce unauthorized dispensing from the valve.

16. A method of quickly filling a container from a refrigerator appliance comprising the steps of:

providing a refrigerator appliance, wherein the refrigerator appliance includes a first dispenser, wherein the first dispenser includes a water storage receptacle, wherein the water storage receptacle includes an inlet and an outlet, wherein the outlet includes a downstream valve and a coupling;

dispensing water from the water storage receptacle through the valve at a first flow rate greater than a second flow rate entering the inlet of the water storage receptacle;

releasably securing one or more attachments to the coupling of the outlet; and indicating volume of the water within the water storage receptacle to a user.

17. The method of claim 16 further comprising the step of filtering the water upstream of the water storage receptacle.

18. The method of claim 16 wherein the first flow rate is about 1 gallon per minute to about 2 gallons per minute.

19. The method of claim 16 further comprising a second dispenser having a third flow rate, wherein the first flow rate is larger than the third flow rate.

20. The method of claim 16 further comprising the step of at least one of heating and cooling water within the water storage receptacle.

21. The method of claim 16 wherein the water storage receptacle is in a housing of the refrigerator appliance.

22. The method of claim 16 wherein the one or more attachments extends the distance the water is dispensed from the refrigerator appliance.

23. The method of claim 16 wherein the coupling is a quick connector.

24. The method of claim 16 further comprising the step of at least one of pumping and gravity dispensing the water from the water storage receptacle.

25. A method of quickly filling a container from a refrigerator appliance comprising the steps of:

providing a refrigerator appliance, wherein the refrigerator appliance includes a first dispenser, wherein the first dispenser includes a water storage receptacle, wherein the water storage receptacle includes an inlet and an outlet, wherein the outlet includes a downstream valve and a coupling;

dispensing water from the water storage receptacle through the valve at a first flow rate greater than a second flow rate entering the inlet of the water storage receptacle;

a second dispenser having a third flow rate, wherein the first flow rate is larger than the third flow rate; and releasably securing one or more attachments to the coupling of the outlet.

* * * * *